United States Patent [19]

Longworth

[11] Patent Number: 4,785,476

[45] Date of Patent: Nov. 22, 1988

[54] FACE SHIELD

[76] Inventor: Uranna Longworth, 5666 La Jolla Blvd., #60, La Jolla, Calif. 92037

[21] Appl. No.: 105,618

[22] Filed: Oct. 8, 1987

[51] Int. Cl.[4] ..... A45D 4/18; A42B 1/00

[52] U.S. Cl. ..... 2/9

[58] Field of Search ..... 2/9

[56] References Cited

U.S. PATENT DOCUMENTS

| | | | |
|---|---|---|---|
| D. 180,006 | 4/1957 | Barth . | |
| D. 210,183 | 2/1968 | Ross | 2/9 X |
| D. 223,737 | 5/1972 | Smith | 2/9 X |
| D. 225,910 | 1/1973 | Kurianski | 2/9 X |
| D. 236,661 | 9/1975 | Weaver . | |
| D. 250,296 | 11/1978 | Breland . | |
| 2,205,972 | 6/1940 | Davis . | |
| 2,241,855 | 5/1941 | Heisterberg | 2/174 |
| 3,060,445 | 10/1962 | Brockman | 2/9 |
| 3,103,667 | 9/1963 | Rogowski | 2/9 |
| 3,206,760 | 9/1965 | Santala | 2/9 |
| 3,317,921 | 5/1967 | Zarzour | 2/9 |
| 3,488,772 | 1/1970 | Sturm | 2/9 |
| 3,602,913 | 9/1971 | Neese | 2/9 |
| 3,963,034 | 6/1976 | Runberg | 2/9 X |

*Primary Examiner*—Louis K. Rimrodt

*Attorney, Agent, or Firm*—Birch, Stewart, Kolasch & Birch

[57] ABSTRACT

A face shield is provided for positioning on a forehead of an individual to help protect an individual from heat, wind, light and chemical sprays. A substantially conical member includes a base portion and a top portion displaced a predetermined distance from the base portion. The top portion is formed as a substantially elliptical section projecting through the substantially conical member. A slit connects the top portion with the base portion for defining a through opening in the substantially conical member. The substantially conical member is constructed of a resilient material for enabling the substantially conical member to be biased to an open position for mounting the substantially conical member on a forehead of an individual.

2 Claims, 2 Drawing Sheets

FACE SHIELD

BACKGROUND OF THE INVENTION

1. Field of the Invention

The present invention is directed to a face shield for positioning on the forehead of an individual to help protect the individual from heat, hair, blowing air or spray chemicals and other irritable material impinging upon an individual's face.

2. Description of Background Art

Hithertofore, an individual utilizing a conventional hair drying machine at a beauty parlor or other place of business is subjected to the hot air blowing directly on the individual's forehead and/or face. In addition, chemicals sprayed onto an individual's hair often impinge upon the individual's face causing discomfort or potential hazard to the individual's face and eyes.

SUMMARY AND OBJECTS OF THE INVENTION

An object of the present invention is to provide a face shield for positioning on an individual's forehead to help protect the individual from heat, hair, wind, light, and chemical sprays.

A further object of the present invention is to provide a substantially conical member having a top portion formed as a substantially elliptical section with a slit projecting therethrough to permit the substantially conical member to be positioned on an individual's face due the resiliency of the material from which the substantially conical member is constructed.

A further object of the present invention is to provide a face shield which conforms to most individuals' foreheads from temple to temple in full contact therewith.

Another object of the present invention is to construct a face shield from a heat insulating material such as polystyrene, to help protect an individual from heat generated by a conventional hair dryer.

These and other objects of the present invention are achieved by providing a face shield for positioning on a forehead of a individual to protect the individual from heat, wind, light and chemical sprays. A substantially conical member is provided having a base portion and a top portion displaced a predetermined distance from the base portion. The top portion is formed as a substantially elliptical section projecting through the substantially conical member. A slit connects the top portion with the bottom portion for defining a through opening in the substantially conical member. The substantially conical member is constructed of a resilient material for enabling the substantially conical member o be biased to an open position for mounting the substantially conical member on a forehead of an individual.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
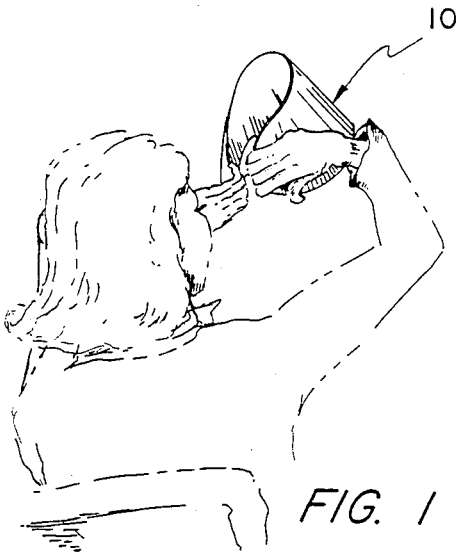
FIG. 1 is a perspective view illustrating a face shield according to the present invention being biased to an open position by an individual.

As illustrated in FIGS. 1–6, a face shield 10 is constructed of a material which is formed in a substantially conical shape. The face shield 10 includes a top portion 14 which is formed as a substantially elliptical section. A top portion 18 and a base portion 12 may be provided with a substantially thickened member for adding rigidity to the face shield 10. However, this is not essential to the face shield.

A slit 16 connects the substantially elliptical section 14 with the face portion 12. In addition, the top portion 14 includes a section 18 adjacent the upper end thereof which generally conforms to the forehead of an individual from temple to temple with full contact therebetween on most individuals.

Figure 6:
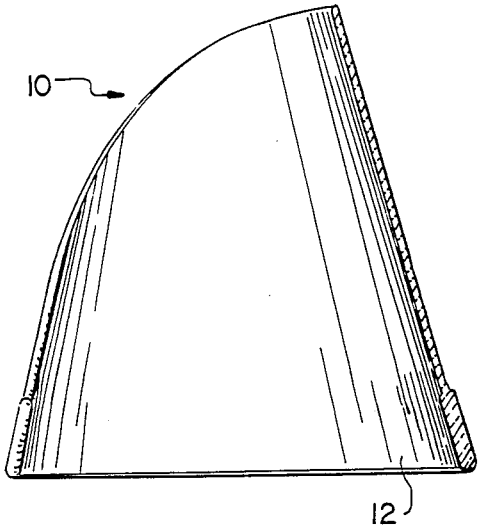
FIG. 6 is a cross-sectional view of the face shield taken along lines 6—6 as illustrated in FIG. 5.

As illustrated in FIG. 6, the face shield 10 may be constructed of a heat insulating material. A polystyrene material may be utilized to construct the substantially conical face shield 10. Extruded polystyrene material is one material which may be used to form the face shield 10 of the present invention.

The face shield 10 of the present invention may be constructed of a specific material which provides the resiliency, strength and grip of the face shield 10 to the forehead of an individual. In addition, the specific design of the face shield 10 being a substantially conical member with the substantially elliptical section removed therefrom, also provides the necessary strength and grip to secure the face shield 10 to the forehead of an individual.

The face shield 10 may be constructed by injection molding of a plastic material to the specific shape of the face shield 10. In the alternative, a preferred method of constructing the face shield 10 is to wrap the material from which the face shield 10 is constructed around a mandrel to provide a suitable shape for the face shield 10. Other mechanical methods may also be employed.

Figure 2:
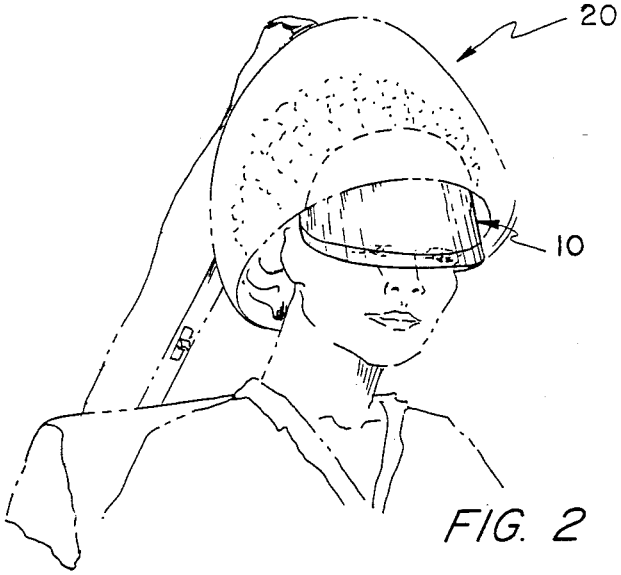
FIG. 2 is a perspective view illustrating the face shield in normal use.
Figure 3:
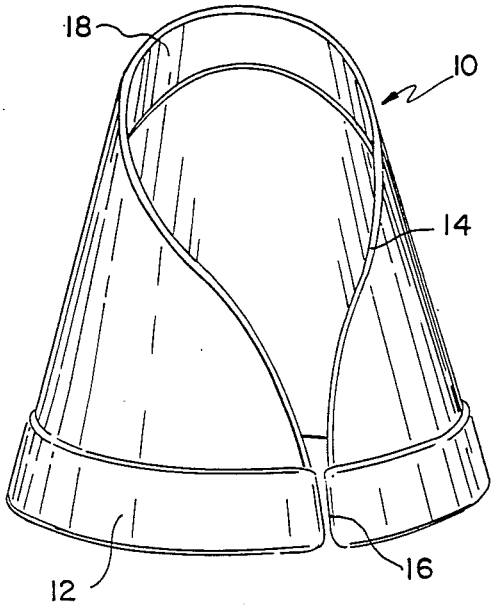
FIG. 3 is a rear elevational view illustrating the substantially conical member having a substantially elliptical section with a slit connecting a top portion to a bottom portion.
Figure 4:
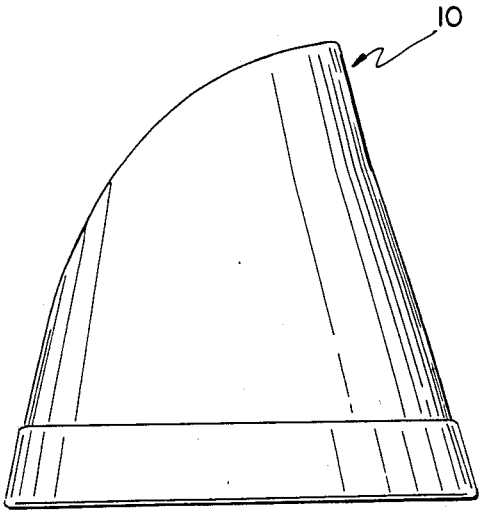
FIG. 4 is a side elevational view of the face shield.
Figure 5:
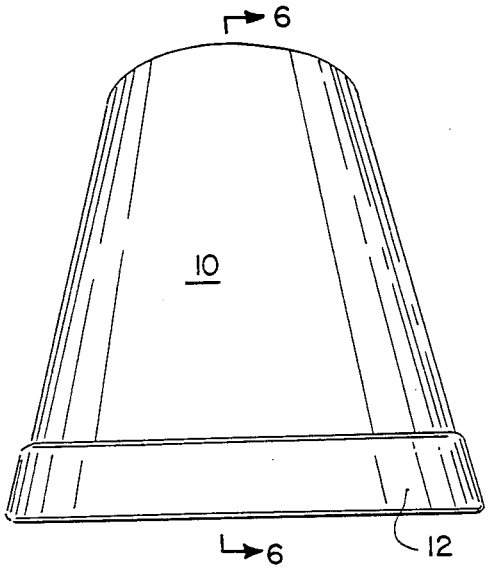
FIG. 5 is a front elevational view of the face shield.

As illustrated in FIG. 2, the face shield 10 is designed to be worn on the forehead of an individual to protect the individual against heat, wind, light and chemical sprays. A hair dryer 20 is normally employed in a beauty parlor or other establishment to dry the hair of an individual. Thus, the face shield 10 may be worn on the forehead of the individual to help insulate the individual from the heat generated by the hair dryer 20

The face shield 10 of the present invention is a lightweight device which may be suspended entirely by its own resilient force across the forehead of an individual. The torsion or natural curl and shape of the face shield 10 provides the necessary resiliency to secure the face shield 10 to the individual's forehead. The face shield 10 is suspended without the aid of any other device or attachment or support. The face shield 10 actually spans the wearer's forehead from temple to temple.

One feature of the present invention is to provide a face shield 10 which does not totally obscure the field of vision of an individual wearing the face shield 10. An individual may still see under the bottom of the face shield 10, thus permitting the individual to read, walk, or tilt his/her head back to increase his/her field of vision.

Constructing the face shield 10 from a heat insulating material enables an individual to maintain a lower body temperature by helping to insulate the individual's face from heat applied by a conventional hair dryer 20. The face shield 10 also assists, not only in reducing the body temperature of an individual, but also reduces the effects of dehydration on the individual's face and eyes caused by blowing hot air.

The face shield 10 is readily disposable. Thus, an individual may discard the face shield 10 after use. The face shield 10 is hygienic due to the fact that it may be discarded after use. If desired, an individual may retain the face shield 10 for repeated use. The face shield 10 is lightweight, comfortable and easy to use.

The face shield 10, according to the present invention, is adjustable for all head sizes. An individual, as illustrated in FIG. 1, merely is required to stretch the face shield 10 to an open position in order to permit an individual to insert his/her forehead into the opening formed in the face shield 10. One size fits all.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A face shield for selectively positioning and retaining on a forehead of an individual to help protect an individual comprising:

a substantially conical member having a base portion and a top portion displaced a predetermined distance from said base portion for positioning on and covering only the upper face portion of an individual while enabling exposure and ventilation for the individual;

said top portion being formed as a substantially elliptical section projecting through said substantially conical member; and a slit connecting said top portion with said bottom portion for defining a through opening in said substantially conical member said top portion and slit conforming with full contact to the forehead of an individual in use;

said substantially conical member being constructed of a resilient, heat insulating, polystyrene material for enabling said substantially conical member to be readily adjustable and manually biased to an open position for selectively mounting and retaining said substantially conical member on a forehead of an individual for affixing and retaining said conical member thereon with a resilient force of the biased face shield without further use of an individual's hands to retain the shield on the forehead.

2. A face shield according to claim 1, wherein said top or bottom portion includes a thickened section having a predetermined height dimension for adding rigidity to said substantially conical member.

* * * * *